US009286743B2

(12) United States Patent
Lopez

(10) Patent No.: US 9,286,743 B2
(45) Date of Patent: Mar. 15, 2016

(54) KEY STORAGE AND RETRIEVAL

(71) Applicant: Secured Mobility, LLC, Georgetown, TX (US)

(72) Inventor: Emmanuel Enrique Lopez, Georgetown, TX (US)

(73) Assignee: Secured Mobility, LLC, Georgetown, TX (US)

( * ) Notice: Subject to any disclaimer, the term of this patent is extended or adjusted under 35 U.S.C. 154(b) by 151 days.

(21) Appl. No.: 14/212,120

(22) Filed: Mar. 14, 2014

(65) Prior Publication Data

US 2014/0266580 A1 Sep. 18, 2014

Related U.S. Application Data

(60) Provisional application No. 61/790,367, filed on Mar. 15, 2013.

(51) Int. Cl.
*G07C 9/00* (2006.01)

(52) U.S. Cl.
CPC ..... *G07C 9/00571* (2013.01)

(58) Field of Classification Search
CPC ..... G07C 9/00007; G07C 9/00103; G07C 9/00166; G07C 9/00571; E05B 77/00
USPC ..... 340/5.6
See application file for complete search history.

(56) References Cited

U.S. PATENT DOCUMENTS 3,821,704 A 6/1974 Sabsay
5,046,093 A 9/1991 Wachob
5,617,323 A * 4/1997 Stansberry ..... G01B 7/287 235/375
5,650,774 A 7/1997 Drori
5,661,804 A 8/1997 Dykema et al.
5,740,428 A * 4/1998 Mortimore ..... G06F 19/321
5,864,297 A 1/1999 Sollestre et al.
5,926,103 A 7/1999 Petite
6,501,369 B1 12/2002 Treharne
6,801,967 B2 10/2004 Nakamura et al.
6,956,460 B2 10/2005 Tsui
6,998,956 B2 2/2006 Dix
7,124,058 B2 10/2006 Namaky et al.
7,315,238 B2 1/2008 Chambers et al.

(Continued)

OTHER PUBLICATIONS

Operator s Instructions DJ-CM2000 Scanner/Transmitter Duplicator.

(Continued)

*Primary Examiner* — Fekadeselassie Girma
*Assistant Examiner* — Stephen Burgdorf
(74) *Attorney, Agent, or Firm* — Fish & Richardson P.C.

(57) ABSTRACT

Methods and systems for providing key storage and retrieval services to be performed by a service provider. The service provider provides a template to a client and instructs the client to use the template to capture, for each vehicle of a plurality of vehicles, both a vehicle identifier and a key of the vehicle in an image. The service provider stores the image in a computing system, extracts the vehicle identifier from the stored image, and associates the vehicle identifier with a location identifier corresponding to a location where the key is stored. When the service provider receives from the client a request for retrieving a key for a specific vehicle, the service provider searches a vehicle identifier of the specific vehicle in the computing system, retrieves the requested key from the location associated with the vehicle identifier, and sends the requested key to the client.

20 Claims, 5 Drawing Sheets

(56) References Cited

U.S. PATENT DOCUMENTS

| | | | | |
|---|---|---|---|---|
| 7,900,966 | B1 * | 3/2011 | Stennett | A45C 11/323 206/37.1 |
| 8,350,670 | B2 | 1/2013 | Kelly et al. | |
| 8,466,774 | B2 | 6/2013 | Lopez et al. | |
| 8,584,841 | B1 * | 11/2013 | Tiegs | B65D 69/00 206/232 |
| 8,854,181 | B2 | 10/2014 | Lopez et al. | |
| 8,912,883 | B2 * | 12/2014 | Kobres | G06Q 10/02 340/5.2 |
| 2003/0112121 | A1 | 6/2003 | Wilson | |
| 2004/0066308 | A1 | 4/2004 | Sampsell | |
| 2004/0088228 | A1 * | 5/2004 | Mercer | G06Q 10/08 705/28 |
| 2004/0113786 | A1 * | 6/2004 | Maloney | G07C 9/00103 340/568.1 |
| 2004/0155793 | A1 | 8/2004 | Mui | |
| 2004/0252030 | A1 | 12/2004 | Trimble et al. | |
| 2005/0024229 | A1 | 2/2005 | Chuey | |
| 2005/0212655 | A1 | 9/2005 | Underdahl | |
| 2005/0225429 | A1 | 10/2005 | Burzio | |
| 2005/0231323 | A1 | 10/2005 | Underdahl et al. | |
| 2005/0248436 | A1 | 11/2005 | Hohmann et al. | |
| 2005/0269414 | A1 * | 12/2005 | Kell | G07C 9/00896 235/492 |
| 2005/0285724 | A1 | 12/2005 | Schmidt et al. | |
| 2006/0176146 | A1 | 8/2006 | Krishan et al. | |
| 2006/0179057 | A1 | 8/2006 | Moretti | |
| 2006/0198523 | A1 | 9/2006 | Shearer | |
| 2007/0001805 | A1 | 1/2007 | Utter et al. | |
| 2007/0008168 | A1 | 1/2007 | Liao et al. | |
| 2007/0096940 | A1 | 5/2007 | Laranang et al. | |
| 2007/0120641 | A1 | 5/2007 | Sommer et al. | |
| 2007/0200671 | A1 | 8/2007 | Kelley et al. | |
| 2007/0229301 | A1 | 10/2007 | Katz | |
| 2008/0150685 | A1 | 6/2008 | Desai et al. | |
| 2009/0113963 | A1 | 5/2009 | Pocrass | |
| 2010/0045423 | A1 * | 2/2010 | Glickman | G06Q 10/087 340/5.1 |
| 2011/0190962 | A1 | 8/2011 | Peterson et al. | |
| 2013/0226795 | A1 | 8/2013 | Hopper et al. | |
| 2013/0331976 | A1 * | 12/2013 | Freeman | B23C 3/35 700/117 |
| 2014/0152882 | A1 * | 6/2014 | Samek | G06Q 10/08 348/333.02 |
| 2014/0229316 | A1 * | 8/2014 | Brandon | G06Q 30/0611 705/26.4 |
| 2014/0266579 | A1 | 9/2014 | Lopez | |
| 2014/0266582 | A1 | 9/2014 | Lopez | |
| 2014/0266583 | A1 | 9/2014 | Lopez | |
| 2014/0266587 | A1 | 9/2014 | Lopez | |

OTHER PUBLICATIONS

Operator's Instructions, CT2000E/CT2000SR, Replacement Remote Control Operation.

Operator's Instructions, Model: RMC888; Duplicator Operating Instruction.

Operator's Instructions, "StingPro—Learning Remote—TX-44".

Operator's Instructions, "Skylink" Model 39, Universal Garage Door Remote Control.

Operator's Instructions, "JMA" CTM-200 Remote Control Duplicator Manual.

* cited by examiner

KEY STORAGE AND RETRIEVAL

CROSS-REFERENCE TO RELATED APPLICATIONS

This application claims priority to U.S. Application Ser. No. 61/790,367, filed on Mar. 15, 2013.

TECHNICAL FIELD

This disclosure relates generally to providing storage and retrieval services to be performed by a service provider and more particularly to providing key storage and retrieval services.

BACKGROUND

Managing an inventory of articles and corresponding accessories can be challenging. For examples, cars are often sold with two or more identical keys for each car, including a primary key and a second key. Vehicle fleet operators can face a dilemma of keeping track of which keys correspond to which vehicles. In some cases, storing a number of the second keys in a storage facility enables the vehicle fleet operators to have spare keys for use in case that the primary keys of the vehicles get lost. In some cases, retrieving a second key corresponding to a specific vehicle among the number of keys stored in the storage facility is challenging.

SUMMARY

This specification describes technologies relating to providing key storage and retrieval services to be performed by a service provider.

In general, one innovative aspect of the subject matter described in this specification can be embodied in methods that include the actions of providing a template and a guide to a client, wherein the guide includes instructions for the client to, for each vehicle of a plurality of vehicles, perform operations comprising: placing a key corresponding to the vehicle in a first section of the template, arranging the template over a portion of the vehicle so that a vehicle identifier of the vehicle is visible through a second section of the template, capturing a template image of the template so that the key and the vehicle identifier are both visible in the template image, transmitting the template image to the service provider and sending the key to the service provider; receiving the template image for each vehicle and storing the template images of the plurality of vehicles in a computing system; receiving the key corresponding to each vehicle and storing the key into a respective location having a location identifier in a storage facility; and associating, in the computing system and for each key, the corresponding vehicle identifier for the key with the location identifier for the key.

Other embodiments of this aspect include corresponding systems, apparatus, and computer programs, configured to perform the actions of the methods, encoded on computer storage devices. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, cause the apparatus to perform the actions.

Particular embodiments of the subject matter described in this specification can be implemented so as to realize one or more of the following advantages: 1) a client can store and keep tracking a number of keys for a number of vehicles; 2) after storage, the client can quickly retrieve the stored key corresponding to a specific vehicle of the number of vehicles in case that a primary key corresponding to the vehicle gets lost; 3) the client can make a new key for the vehicle based on a stored image including information of a vehicle identifier of the vehicle and the stored key of the vehicle; 4) the service provider can also make a new key for the vehicle based on a stored image including information of a vehicle identifier of the vehicle and the stored key of the vehicle.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference symbols in the various drawings indicate like elements.

DETAILED DESCRIPTION

Figure 1:
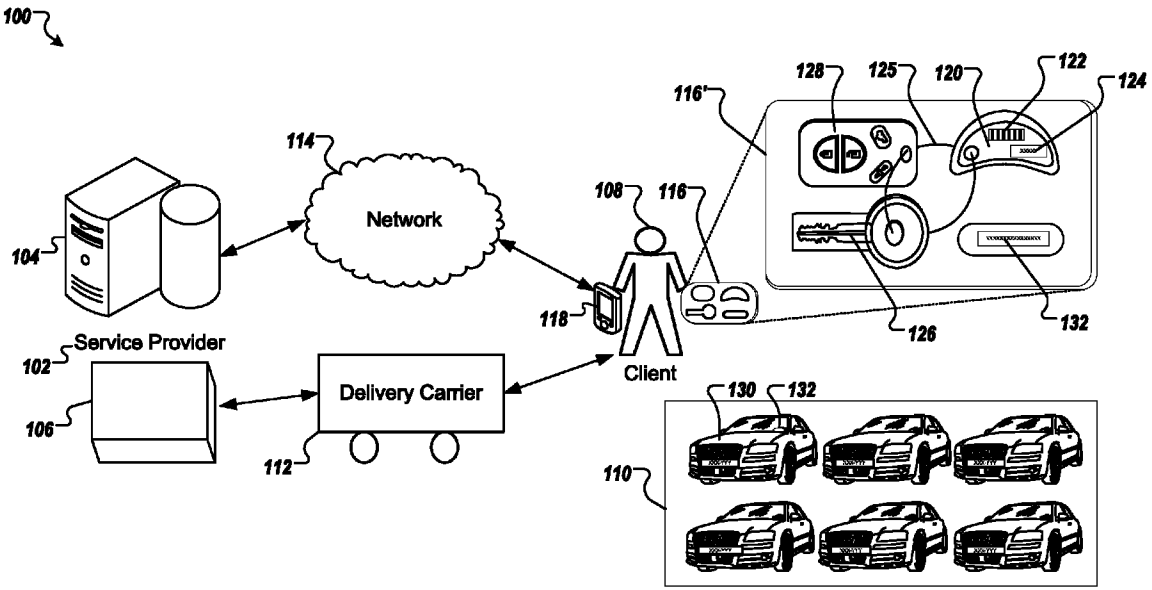
FIG. 1 is a block diagram of an example system architecture for implementing key storage and retrieval services.

FIG. 1 is a block diagram of an example system architecture for implementing key storage and retrieval services. The example system architecture 100 includes a service provider 102 associated with a service computing system 104 and a storage facility 106, a client 108 (e.g., a vehicle fleet operator) associated with a plurality of vehicles 110 (e.g., a fleet of vehicles), a delivery carrier 112 (e.g., a postal service), and a network 114 (e.g., a data communication network).

The service provider 102 provides key storage and retrieval services, through the delivery carrier 112 and the network 114, to the client 108 for storing a number of keys corresponding to the plurality of vehicles 110 in the storage facility 106 and retrieving a specific key corresponding to a specific vehicle among the number of keys from the storage facility 106.

The service provider 102 provides a template 116 to the client 108. The template is a physical object (e.g., a rectangular plate). The template is configured to allow a vehicle identifier of a vehicle and a key corresponding to the vehicle to be captured in a template image. Therefore, the vehicle identifier is associated with the key and information of the vehicle identifier and the key is stored in the template image. The client 108 can use the template to capture a plurality of template images for the plurality of vehicles 110. The service computing system 104 receives the plurality of template images from the client 108, processes each image of the plurality of template images to retrieve the vehicle identifier for the vehicle, and associates, in the service computing system 104, the vehicle identifier with a location identifier corresponding to a respective location where the key corresponding to the vehicle is stored in the storage facility 106.

When the service provider 102 receives from the client 108 a request for a specific key corresponding to a specific vehicle, the service provider 102 can search, in the service computing system 104, a specific vehicle identifier of the specific vehicle provided by the client, to find a specific location identifier associated with the specific vehicle identifier, to determine a specific respective location corresponding to the specific location identifier, to retrieve the specific key from the specific respective location in the storage facility 106, and to send the specific key to the client 108.

In some implementations, the service provider 102 provides a kit to the client 108. The kit includes a template and a guide. The guide can be a printed document or an electronic document. The guide includes instructions for the client 108 to perform operations. The kit can also include pre-paid shipping boxes for the client sending back keys corresponding to vehicles.

In some implementations, the kit includes a plurality of tags having respective tag identifiers. In some examples, the tag identifier 122 is a barcode corresponding to the tag 120. The tag 120 can include an address of the storage facility 106. In some examples, the tag 120 includes a mailing postage guaranteed permit, in case that the tag 120 gets lost and can be returned to the storage facility 106.

The template 116 is a device that allows a vehicle identifier of a vehicle, a key corresponding to a vehicle, and/or a tag identifier of a tag to be viewed simultaneously and captured in a template image. The template can be a handheld device so that the client can carry the template for capturing the template images while walking among the plurality of vehicles. The template can include a first section comprising a window sized to permit viewing a vehicle identifier 132 of a vehicle 130 on a surface of the vehicle. In some examples, the window includes one or more cutouts or a transparent window. The first section is sized to be large enough to view the vehicle identifier. In some examples, the vehicle identifier 132 is a vehicle identification number (VIN) under a windshield of the vehicle 130 or on the inside surface of a front door of the vehicle.

In some implementations, the template includes a magnet. The magnet can be placed on the bottom of the template. The magnet is configured to allow positioning the template on the surface of the vehicle to view the vehicle identifier so that a user doesn't need to hold the template by hand. Thus the user can use both hands to perform other actions, e.g., capturing a template image.

In some implementations, the template includes a second section defining a first cavity shaped to receive a key of the vehicle. The key can be placed in the template, either horizontally, vertically or along any desired direction. The first cavity can be an indentation or a recessed cavity. The shape of the first cavity can be defined to be corresponding to the shape of the key. In some implementations, the template includes a plurality of cavities to receive a key of the vehicle.

In some examples, the key of the vehicle includes a key set comprising a vehicle key and a key fob. In the example system architecture 100 of FIG. 1, the key of the vehicle is depicted as a key set including the vehicle key 126 and the key fob 128. In some implementations, the template 116 includes one or more transparent overlays, which can be used to provide reference lines and outlines for reading spaces and depths of the vehicle key 126 to determine cut combinations of the vehicle key 126. With the cut combinations of the vehicle key 126, a new vehicle key can be made to be identical to the vehicle key 126 and to perform functions of the vehicle key 126. The template can have a template color contrasting with colors of the vehicle key 126 and the key fob 128 so that the vehicle key and the key fob are visible in the template. In some examples, the key of the vehicle includes the vehicle key. In some examples, the key includes a key integrating functions of both the vehicle key and the key fob.

In some implementations, the template includes a section defining a separate cavity shaped to receive the tag. The tag can be placed in the template. The separate cavity can be an indentation or a recessed cavity. The shape of the separate cavity is defined to be corresponding to the shape of the tag. In some implementations, the template includes one or more clips to hold the key and/or the tag in a desired place.

In the example system architecture 100 of FIG. 1, the example template 116 includes four separate sections: a first section for viewing the vehicle identifier 132, a second section for holding the vehicle key 126, a third section for holding the tag 120, and a fourth section for holding the key fob 128. The tag 120 can first be attached to the vehicle key 126 and the key fob 128 with a connector 125 (e.g., a key ring) to form a tag-key pair, and then placed in the template 116. The template 116 allows the vehicle identifier 132, the vehicle key 126, the tag 120 (including the tag identifier 122 and the address of the storage facility), and the key fob 128 to be viewed simultaneously and captured in an exemplary template image 116'.

In some examples, the template image 116' has a resolution high enough so that a computer system can identify the vehicle identifier 132 from the template image 116', e.g., using image analysis processes such as optical character recognition (OCR). In some examples, the template image 116' has a resolution high enough so that a computer system can extract information of spaces and depths of the vehicle key 126 and determine cut combinations of the vehicle key 126. Based on the cut combinations determined from the template image 116', a new vehicle key can be made to be identical to the vehicle key 126 and to perform functions of the vehicle key 126. In some examples, the template image 116' has a resolution high enough so that a computer system can extract information of the key fob 128, e.g., by reading one or more characters printed on a label of the key fob 128. Based on the information determined from the template image 116', a new key fob can be made to be identical to the key fob 128 and to perform functions of the key fob 128. In some examples, the template image 116' has a resolution high enough so that a computer system can extract information of the tag identifier 122 and/or the address 124 of the tag 120.

In some implementations, the client 108 uses a computing device 118 to capture a template image. The service provider 102 can provide the computing device 118 to the client 108, or the client can use a convention computer device, e.g., a mobile phone or tablet, which can execute software programs provided by the service provider. The computing device 118 can transmit the template images to the service computing system 104 over the network 114. The network 114 can include a large computer network, such as a local area network (LAN), a wide area network (WAN), the Internet, a cellular network, or a combination thereof connecting any number of mobile computing devices, fixed computing devices and server systems.

In some implementations, the service provider 102 provides an application (e.g., a software program) to be installed and executed in the computing device 118. The computing device 118 includes one or more processors. The application can include image analysis processes (e.g., OCR). In some examples, the computing device 118 executes the application to process the template image to identify the vehicle identifier 132 and/or the tag identifier 122 from the template image 116'. In some examples, the computing device 118 executes the application to scan the vehicle identifier 132 and/or the tag identifier 122 to retrieve information of the vehicle identifier 132 and/or the tag identifier 122. The computing device 118 can execute the application to associate the vehicle identifier and/or the tag identifier with the template image.

In some implementations, the client 108 uses the computing device to transmit information of the vehicle identifier and/or the tag identifier together with the template image, to the service computing system 104 over the network 114. The client 108 can transmit the template image, the vehicle identifier, and/or the tag identifier to the service computing system 104 before the service provider receives the key or the tag-key pair associated with the vehicle identifier from the client 108. In some implementations, the client 108 prints the vehicle identifier, attaches the printed vehicle identifier to the key or the tag-key pair, and sends the key or the tag-key pair with the vehicle identifier, to the service provider 102 over the delivery carrier 112.

In some implementations, the client 108 receives a fleet catalogue of vehicle identifiers of an incoming fleet of vehicles. In some examples, the client 108 pre-loads the fleet catalogue into the application in the computing device 118. After receiving the fleet of vehicles, the client 108 first uses the computing device 118 to capture a template image of each of the plurality of vehicles and identify the vehicle identifier of the vehicle. The computing device 118 executes the application to determine whether the identified vehicle identifier is in the preloaded fleet catalogue. If the computing device 118 determines the identified vehicle identifier is in the preloaded fleet catalogue, the computing device gives the client a notice confirming that the vehicle corresponding to the vehicle identifier is received. In some implementations, the client provides the fleet catalogue to the service provider. The service provider preloads the vehicle identifiers in the fleet catalogue and/or a plurality of tag identifiers corresponding to the plurality of tags into the application, and provides the application with the preloaded fleet catalogue and/or the plurality of tag identifiers to the client.

The computing device 118 can include any appropriate type of device such as a tablet computing device, a handheld computer, a mobile device, a personal digital assistant (PDA), a cellular telephone, a network appliance, a camera, a smart mobile phone, an enhanced general packet radio service (EGPRS) mobile phone, a media player, a navigation device, a game console, or any appropriate combination of any two or more of these data processing devices or other data processing devices.

The service computing system 104 can include one or more computing devices and one or more machine-readable repositories, or databases. In some implementations, the service computing system 104 include a database for storing template images and associating vehicle identifiers, tag identifiers, location identifiers and the template images with corresponding tag-key pairs stored in the storage facility 106. The service computing system 104 can include a server. The server can communicate with the database.

In some implementations, a client registers a client account in the server over the network 114. The client can request, on the server, the service provider 102 to send a kit to a client location or retrieve a specific key corresponding to a specific vehicle. The client can access the server to search a specific vehicle identifier in the server to determine whether the specific vehicle identifier is in the database and whether the specific key associated with the specific vehicle identifier is in the storage facility. The client can access the server to view a catalogue associated with the client account.

TABLE 1

Catalogue associated with stored tag-key pairs

| No. | Vehicle Identifier | Location Identifier | Tag Identifier | Template Image | Status |
|---|---|---|---|---|---|
| 10 | 1HGCP2F46CA142528 | A16 | 780863 185778 | Image 10 | In storage |
| 11 | 1HGCS2B86AA006131 | B20 | 780863 185779 | Image 11 | Shipped back |

In some examples, the catalogue is a table. Table 1 is an exemplary catalogue listing information of vehicle identifiers, location identifiers, tag identifiers and template images associated with the client's vehicles and corresponding tag-key pairs stored in the storage facility 106. The content in the template image column of Table 1 (e.g., Image 10) is linked to a template image associated with the vehicle identifier "1HGCP2F46CA142528". The catalogue can include current status of the tag-key pairs (e.g., received, in storage, shipped back, or lost). In some implementations, the service computing system 104 sends aggregated reports to the client 108 periodically so that the client can monitor the catalogue associated with the client account.

In some implementations, the service provider 102 sends kits or retrieved keys to the client 108 and receives tag-key pairs from the client 108 over the delivery carrier 112. The delivery carrier 112 provides services including one or more of overnight delivery service, same-day delivery service, one-day delivery service, two-day delivery service, three-day delivery service, tracking service, and picking up service. The delivery carrier includes one or more of the United States Postal Service (USPS), UPS, FedEx, and DHL.

In some implementations, the service provider 102 and the client 108 are included in a single business entity. The delivery carrier 112 and the network 114 are optional in the system architecture 100. In some implementations, the service provider 102 operates the storage facility 106. In some implementations, the service provider 102 stores keys in a third entity that operates the storage facility 106.

Figure 2:
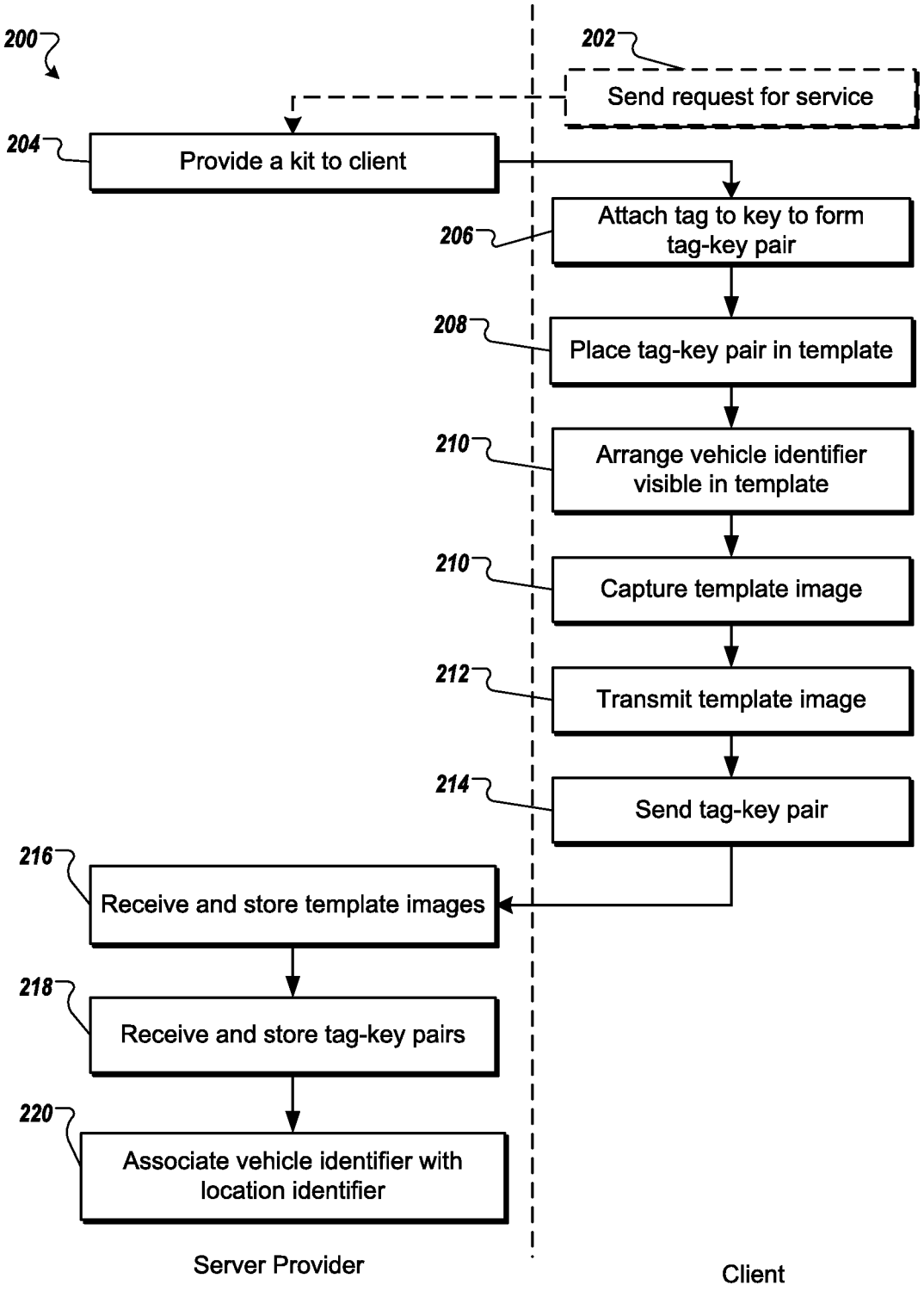
FIG. 2 is a flow diagram of an example process for implementing key storage services.
Figure 3:
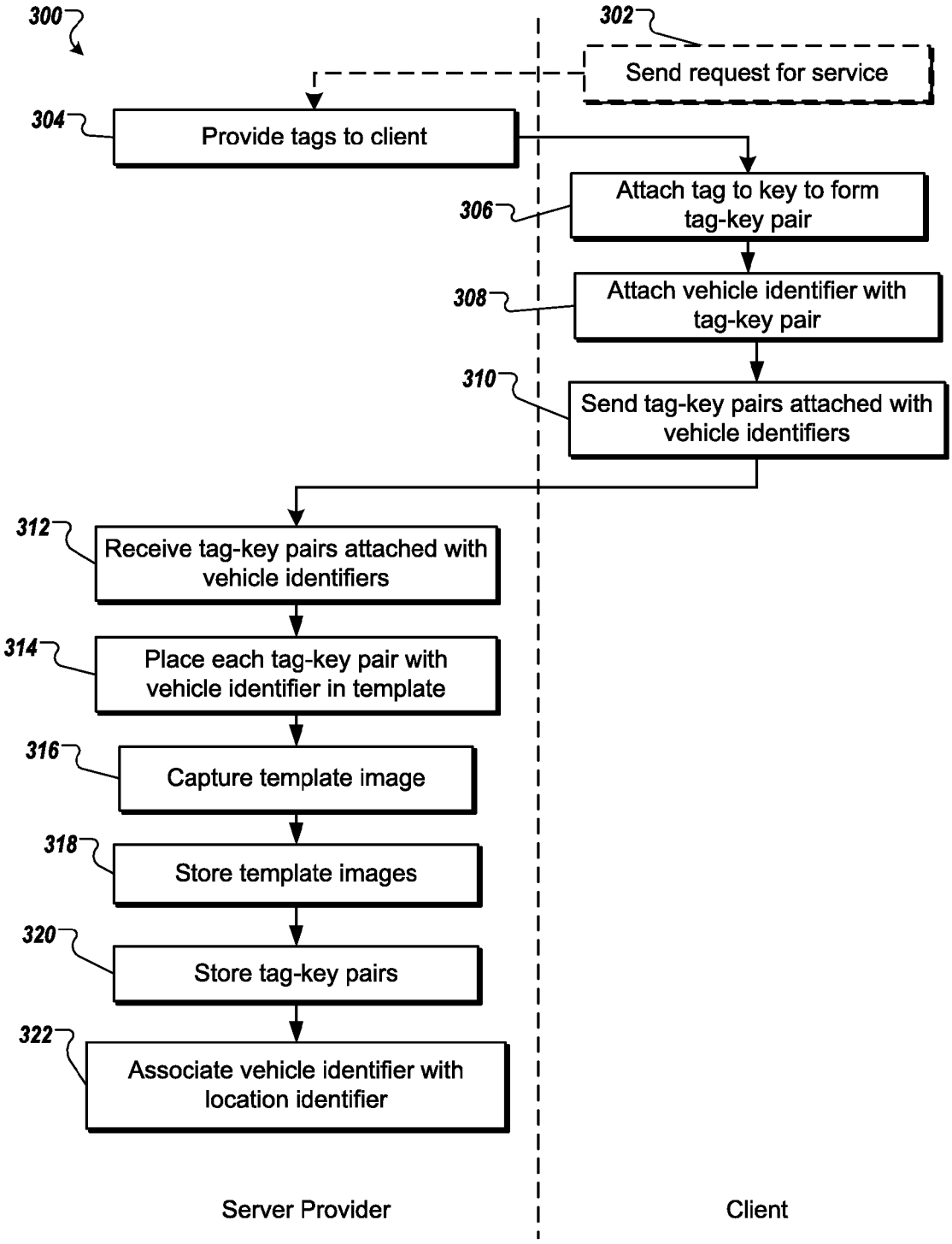
FIG. 3 is a flow diagram of another example process for implementing key storage services.
Figure 4:
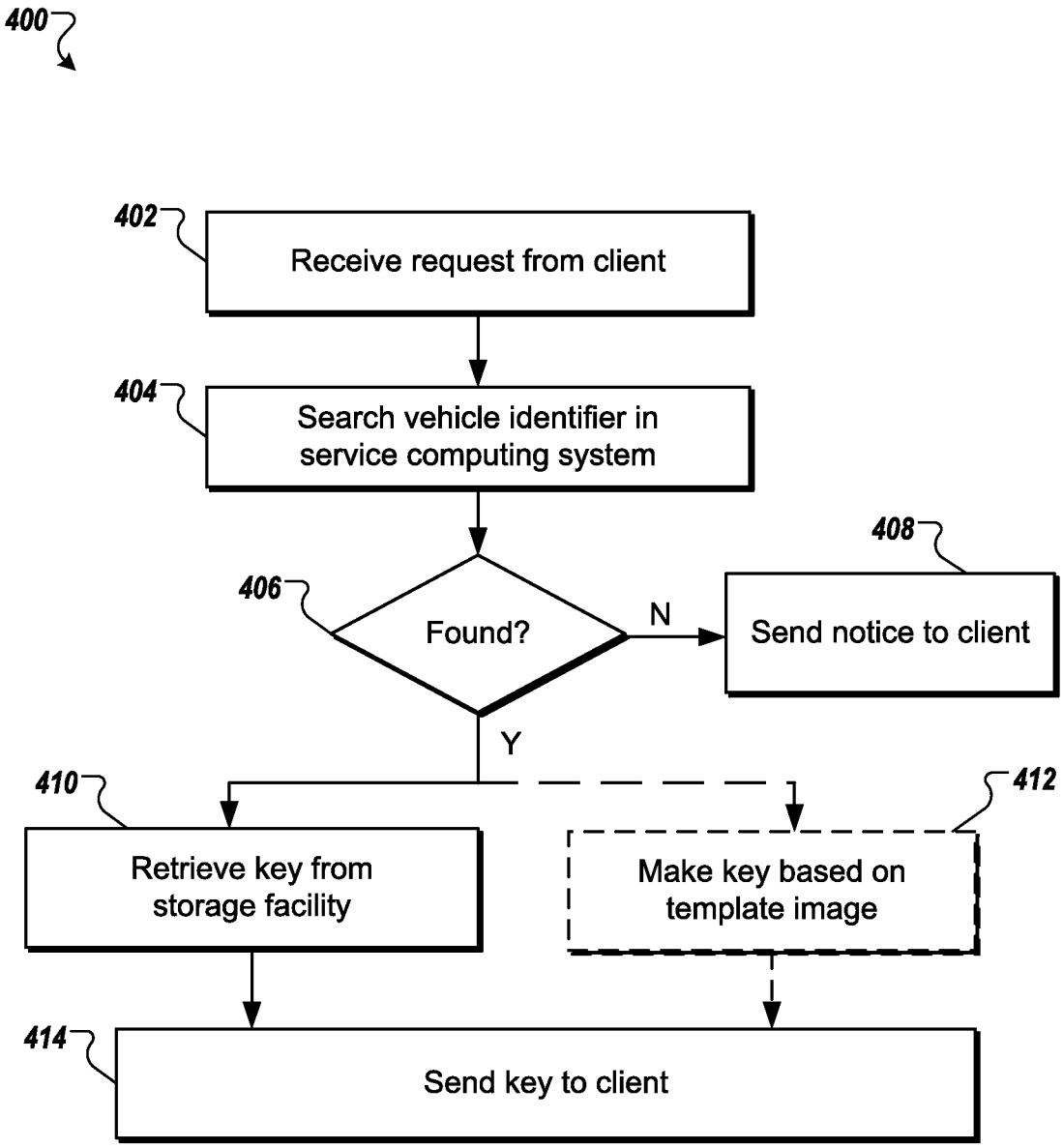
FIG. 4 is a flow diagram of an example process for implementing key retrieval services.

Referring now to FIGS. 2, 3 and 4, implementations of the present disclosure will be described in further detail. In the following discussion, for exemplary purposes, the labels in the example system architecture 100 of FIG. 1 are used to present corresponding devices or systems.

FIG. 2 is a flow diagram of an example process 200 for implementing key storage services. The process 200 can be performed by a service provider (e.g., the service provider 102 of FIG. 1) and a client (e.g., the client 108 of FIG. 1). The service provider is associated with a service computing system (e.g., the service computing system 104 of FIG. 1) and a storage facility (e.g., the storage facility 106 of FIG. 1). The client is associated with a fleet of vehicles (e.g., the vehicles 110 of FIG. 1) and a computing device (e.g., the computing device 118 of FIG. 1).

A client sends a request to a service provider for key storage and retrieval services (step 202). In some examples, the client can use a web browser running on a client-side computing device (e.g., the computing device 118 of FIG. 1 or a desktop computer), to access a server in the service computing system of the service provider over a network (e.g., the network 114 of FIG. 1) and submit the request.

The service provider provides a kit to the client (step 204). In some examples, the service provider sends the kit over a delivery carrier (e.g., the delivery carrier 112 of FIG. 1) after receiving the request from the client. The service provider can choose corresponding delivery services based on the client's request (e.g., overnight delivery service). In some examples, the service provider determines a potential client and sends the kit to the potential client without receiving a request from the potential client.

The kit comprises a template (e.g., the template 116 of FIG. 1), a guide including instructions for the client to perform operations, and a plurality of tags having respective tag identifiers. The number of the plurality of tags can be larger than the number of the plurality of vehicles. In some examples, the guide is a printed document (e.g., a booklet). The client can read the guide and perform the operations following the instructions in the guide. In some examples, the guide is an electronic document. The electronic document can be stored in a non-transitory computing storage medium mailed with the kit to the client. The electronic document can be sent to the client by a data transfer service (e.g., E-mail). The electronic document can also be put in the server of the service computing system. The client can use the client-side computing device to access the server, view the electronic document, and perform the operations by following the instructions.

The client performs the following operations for each vehicle of the fleet of vehicles.

First, the client attaches a tag (e.g., the tag 120 of FIG. 1) of the plurality of tags having a tag identifier (e.g., the tag identifier 122 of FIG. 1) to a key (e.g., the vehicle key 126 and/or the key fob 128 of FIG. 1) corresponding to the vehicle (e.g., the vehicle 130 of FIG. 1) to form a tag-key pair for the vehicle (step 206). In some examples, the client uses a connector (e.g., the connector 125 of FIG. 1), through holes in the tag and the key, to connect the tag with the key.

Second, the client places the tag-key pair into one or more sections of the template (step 208). As depicted in FIG. 1 and described above, the template can include a second section for holding the key and a third section for holding the tag.

Third, the client arranges the template over a portion of the vehicle so that a vehicle identifier (e.g., the vehicle identifier 132 of FIG. 1) of the vehicle is visible through a first section of the template (step 210). In some examples, the vehicle identifier is under a windshield of the vehicle. The client can put the template with the tag-key pair on top of the windshield to allow the vehicle identifier visible through the first section of the template.

Fourth, the client captures a template image (e.g., the template image 116' of FIG. 1) of the template so that the tag-key pair and the vehicle identifier are both visible in the template image. As described above, the template image can have a resolution high enough to identify information of the vehicle identifier and the tag-key pair. The client can use the computing device to capture the template image.

In some implementations, the client receives an application from the service provider and installs the application in the computing device. As described above, the computing device can execute the application to identify information of the vehicle identifier and the tag-key pair either by processing the template image or by scanning the vehicle identifier and the tag identifier. In some implementations, the client uses the computing device to print out the identified vehicle identifier and attaches the printed vehicle identifier to the tag-key pair.

In some implementations, the client transmits the individual template image to the service computing system over the network (step 212). The client can use the computing device to transmit the template image. The client can transmit the template image together with the vehicle identifier and the tag identifier.

In some implementations, the client transmits the plurality of template images of the plurality of vehicles to the service computing system over the network (step 212). The client can use the computing device to transmit the plurality of template images. The client can also use the client-side computing device to transmit the plurality of template images. The client can transmit the plurality of template images together with a first catalogue including the vehicle identifiers and the tag identifiers corresponding to the plurality of template images.

The client sends a plurality of tag-key pairs corresponding to the plurality of vehicles to the service provider over the delivery carrier (step 214). In some implementations, the client prints out the first catalogue and sends it to the service provider together with the plurality of tag-key pairs. The client can send the plurality of tag-key pairs after the client transmits the plurality of template images.

The service provider receives the template image for each vehicle of the plurality of vehicles and stores the plurality of template images in the service computing system (step 216). The service computing system can include a database for storing the plurality of template images. In some implementations, the service provider uses the service computing system to process the template image for each tag-key pair to identify the vehicle identifier and the tag identifier corresponding to the tag-key pair. The service computing system can generate a second catalogue including the vehicle identifiers and the tag identifiers.

The service provider receives the plurality of tag-key pairs for each vehicle and stores each tag-key pair into a respective location having a location identifier (e.g., A16 or B20 of Table 1) in the storage facility (step 218). In some implementations, the service provider makes an additional key based on the key of the tag-key pair and sends the plurality of additional keys corresponding to the plurality of tag-key pairs to the client. In some implementations, the service computing system includes a scanning device (e.g., a barcode scanner). The service provider uses the scanning device to scan the tag or the printed vehicle identifier of each tag-key pair and to identify a tag identifier or a vehicle identifier corresponding to the tag-key pair.

In some implementations, the service computing system pre-loads the first catalogue received from the client and determines whether the identified tag identifier or vehicle identifier is in the first catalogue. If the service computing system finds the identified tag identifier or vehicle identifier is in the first catalogue, the service computing system generates a first notice indicating that the tag-key pair corresponding to the identified tag identifier or vehicle identifier is received.

In some implementations, after the scanning device scans the tag-key pair and identifies the tag identifier or the vehicle identifier, the service computing system determines whether the identified tag identifier or vehicle identifier is in the second catalogue. In some examples, the service computing system finds that the identified tag identifier or vehicle identifier is in the second catalogue and is associated with a template image, the service computing system will generate a second notice. The second notice indicates that the tag-key pair corresponding to the identified tag identifier or vehicle identifier is received. In some examples, the service computing system finds the identified tag identifier or vehicle identifier is not in the second catalogue, the service computing system will generate a fail notice indicating that the template image for the tag-key pair corresponding to the identified tag identifier or vehicle identifier is not received from the client. The service computing system will update the second catalogue to include the new tag identifier or vehicle identifier corresponding to the tag-key pair. The service provider will also request the client to transmit the template image for the tag-key pair corresponding to the identified tag identifier or vehicle identifier to the service computing system.

The service provider associates, in the service computing system and for each tag-key pair, the corresponding vehicle identifier for the tag-key pair with the location identifier for the tag-key pair (step 220). In some implementations, the service computing system updates the second catalogue to include the location identifier for each tag-key pair and associates the corresponding vehicle identifier for the tag-key pair with the location identifier for the tag-key pair, the template image for the tag-key pair and the tag identifier corresponding to the tag-key pair in the database of the service computing system. Based on the updated second catalogue and the associated information, the service computing system can generate a third catalogue including the vehicle identifiers, the location identifiers, the template images, and the tag identifiers (e.g., Table 1).

In some implementations, the service computing system associates the third catalogue with a client account that the client is registered in the server. The client can access the server to view the third catalogue corresponding to the plurality of tag-key pairs sent to the service provider and stored in the storage facility. In some implementations, the service computing system generates a report including the third catalogue. The service provider sends either over the delivery carrier or transmits over the network the report to the client to confirm that the plurality of tag-key pairs and the plurality of template images are received.

The example process 200 can be implemented with attaching a tag having a tag identifier to a key corresponding to each vehicle of the fleet of vehicles, as described above. The tag identifier provides identification functions enabling the service provider to identify each tag-key pair received from the client and to associate the received tag-key pair with a received template image for the tag-key pair.

In some implementations, the example process 200 can be implemented without a tag having a tag identifier. After the computing device extracts information of the vehicle identifier from the captured template image, the client can use the computing device to print out the extracted vehicle identifier and attaches the printed vehicle identifier to the key. After the service provider receives the key with the printed vehicle identifier, the service provider can use the scanning device to scan the printed vehicle identifier and identify the vehicle identifier of the key. The service provider can search the identified vehicle identifier in the service computing system to determine whether the identified vehicle identifier is in the second catalogue. If the printed vehicle identifier is in the second catalogue, the service computing system can associate the key attached with the printed vehicle identifier with the received template image for the key. Therefore, the printed vehicle identifier can realize the identification functions of the tag identifier, and the example process 200 can be implemented without a tag having a tag identifier.

FIG. 3 is a flow diagram of another example process 300 performed by a service provider for providing key storage services to a client.

The client sends a request to a service provider for key storage and retrieval services (step 302). The service provider provides the client a plurality of tags having respective tag identifiers and a guide including instructions for the client to perform operations (step 304).

The client performs the following operations for each vehicle of a plurality of vehicles. First, the client attaches a tag of the plurality of tags to a key corresponding to the vehicle to form a tag-key pair for the vehicle (step 306). Second, the client attaches a vehicle identifier of the vehicle (e.g., a printed vehicle identifier label) to the tag-key pair (step 308).

The client sends the tag-key pairs for the plurality of vehicles attached with the corresponding vehicle identifiers to the service provider (step 310);

After receiving the tag-key pairs attached with the corresponding vehicle identifiers (step 312), the service provider places the tag-key pair for each vehicle of the plurality of vehicles and the corresponding vehicle identifier in a template so that the tag-key pair and the corresponding vehicle identifier are both visible in the template (step 314). In some implementations, the service provider uses a scanning device to scan the tag-key pair to retrieve the tag identifier for the tag-key pair and store the retrieved tag identifier in a computing system of the service provider (e.g., the computing system 104 of FIG. 1).

Then the service provider captures a template image of the template so that the tag-key pair for the vehicle and the corresponding vehicle identifier are both visible in the second template image (step 316), and stores the template images of the plurality of vehicles in the computing system (step 318).

The service provider stores the tag-key pair for each vehicle of the plurality of vehicles into a respective location having a location identifier in a storage facility (e.g., the storage facility 106 of FIG. 1) (step 320). Then the service provider uses the computing system to process the template image for each tag-key pair to retrieve the corresponding vehicle identifier for the tag-key pair and the tag identifier for the tag-key pair, and associates, in the computing system and for each tag-key pair, the corresponding vehicle identifier for the tag-key pair with the location identifier for the tag-key pair and the corresponding tag identifier for the tag-key pair (step 322).

In some implementations, the example process 300 can be implemented without sending the plurality of tags to the client. After the service provider receives a request from the client for key storage and retrieval service, the service provider can instruct the client to attach, for each vehicle of the plurality of vehicles, the corresponding vehicle identifier of the vehicle to the corresponding key of the vehicle and then to send the plurality of keys attached with the corresponding vehicle identifiers to the service provider.

After receiving the keys attached with the corresponding vehicle identifiers, the service provider can put each key and corresponding vehicle identifier in a template and take a template image of the template so that both the key and the vehicle identifier visible in the template image.

In some implementations, the service provider can attach a tag having a tag identifier with each key to form a tag-key pair for each vehicle of the plurality of vehicles. The service provider places the tag-key pair and the corresponding vehicle identifier in the template and takes the template image so that the key, the tag identifier and the vehicle identifier visible in the template image.

Then the service provider stores the template images for the plurality of vehicles in the computing system, and stores the key or the tag-key pair for each vehicle of the plurality of vehicles into a respective location having a location identifier in a storage facility. The service provider uses the computing system to process the template image for each key or tag-key pair to retrieve the corresponding vehicle identifier for the key or the tag-key pair or/and the tag identifier for the tag-key pair, and associates, in the computing system and for each key or tag-key pair, the corresponding vehicle identifier for the key or the tag-key pair with the location identifier for the key or the tag-key pair or/and the corresponding tag identifier for the tag-key pair.

FIG. 4 is a flow diagram of an example process 400 performed by a service provider for providing key retrieval services to a client.

The service provider receives from a client a request for a key to a vehicle (step 402). The request includes a vehicle identifier for the vehicle. In some examples, the client uses the client-side computing device to access the server over the network and submits the request through the server. In some examples, the client uses a telecommunication device to call the service provider to submit the request.

The service provider searches for the vehicle identifier in the service computing system (step 404) and determines whether the vehicle identifier is stored in the service computing system (step 406).

If the service computing system finds that the vehicle identifier is not in the service computing system, the service provider will send a notice to the client indicating that the key is not stored in the storage facility (step 408).

If the service computing system finds the vehicle identifier, the service provider can retrieve the requested key from the storage facility by looking up the location identifier associated with the vehicle identifier in the service computing system (step 410). In some implementations, the service provider can find a template image associated with the vehicle identifier in the database and make a new key based on the template image (step 412). As discussed above, the template image can have a resolution high enough to determine information of the key. The service provider can make the separate key identical to the key based on the information and to perform functions of the key.

The service provider sends the retrieved key (or the tag-key pair) or the new key corresponding to the key identifier to the client (414) over the delivery carrier. The service provider can choose a delivery service of the delivery carrier based on the client's request (e.g., overnight delivery service, or same-day delivery service). The service provider can send a message to the client (e.g., a mail, or an E-mail). The message confirms that the service provider receives the request and delivers the requested key to the client. The message can include tracking information for the delivery.

Figure 5:
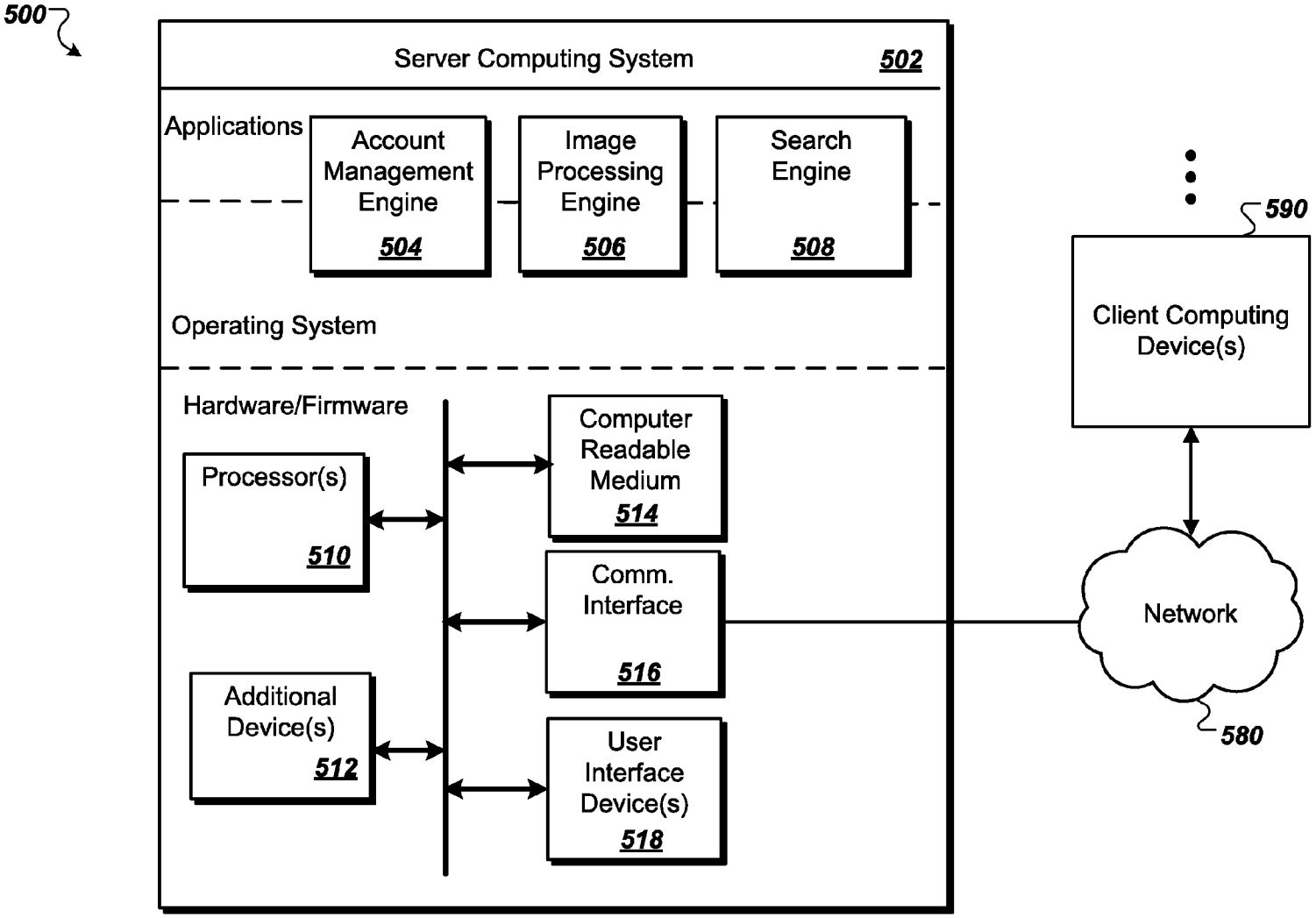
FIG. 5 is a diagram of an example computing system of a service provider.

FIG. 5 is a diagram of an example computing system 502 (e.g., the service computing system 104 of FIG. 1) of a service provider (e.g., the service provider 102 of FIG. 1). In operation, the computing system 502 communicates with one or more client computing devices or mobile devices 590, directly or through a network 580.

The computing system 502 includes one or more data processing apparatus. While only one data processing apparatus is shown in FIG. 5, multiple data processing apparatus can be used. The computing system 502 can be distributed geographically. For example, the computing system 502 can include multiple data processing apparatus in various geographic locations.

The computing system 502 includes various modules, e.g., modules of computer program instructions, including an account management engine 504 configured to manage accounts for a server, including for each account, a username and a password; an image processing generation engine 506 to process images; and a search engine 508 to search a vehicle identifier in the computing system 502.

Each module is configured to run on the computing system 502. For example, a module can run as part of an operating system on the computing system 502, as an application on the computing system 502, or as part of the operating system and part of an application on the computing system 502. Although several software modules are illustrated, the functionality of the computing system may be implemented in fewer or more software modules. Moreover, the software modules can be distributed on one or more data processing apparatus connected by one or more networks or other suitable communication mediums.

The computing system 502 also includes hardware or firmware devices including one or more processors 510, one or more additional devices 512, a computer readable medium 514, a communication interface 516, and one or more user interface devices 518. Each processor 510 is capable of executing instructions for execution within the computing system 502. Each processor 510 is capable of executing instructions stored on the computer readable medium 514 or on a storage device such as one of the additional devices 512. The computing system 502 uses its communication interface 516 to communicate with one or more client computing devices 590, for example, over a network 580. Examples of user interface devices 518 include a display, a camera, a speaker, a microphone, a tactile feedback device, a keyboard, and a mouse. The computing system 502 can store instructions that implement operations associated with the modules described above, for example, on the computer readable medium 514 or one or more additional devices 512, for example, one or more of a floppy disk device, a hard disk device, an optical disk device, or a tape device.

Embodiments of the subject matter and the operations described in this specification can be implemented in digital electronic circuitry, or in computer software, firmware, or hardware, including the structures disclosed in this specification and their structural equivalents, or in combinations of one or more of them. Embodiments of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, embodiments of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Embodiments of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some embodiments, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A method performed by a service provider, the method comprising:

providing a template and a guide to a client, wherein the guide includes instructions for the client to, for each vehicle of a plurality of vehicles, perform operations comprising:

placing a key corresponding to the vehicle in a first section of the template, the key comprising at least one of a physical vehicle key and a key fob;

arranging the template over a portion of the vehicle so that a vehicle identifier of the vehicle is visible through a second section of the template;

capturing a template image of the template so that the key and the vehicle identifier are both visible in the template image;

transmitting the template image to the service provider; and sending the key to the service provider;

receiving the template image for each vehicle and storing the template images of the plurality of vehicles in a computing system;

associating, in the computing system, each template image with a corresponding vehicle identifier;

receiving the key corresponding to each vehicle and storing the key into a respective location having a location identifier in a storage facility;

associating, in the computing system, each associated vehicle identifier with the location identifier of the key corresponding to the vehicle identifier;

receiving from the client a request for a specific key corresponding to a specific vehicle, the request including a specific vehicle identifier of the specific vehicle; and finding the specific vehicle identifier in the computing system, and in response:

retrieving the specific key associated with the specific vehicle identifier, and sending the specific key to the client, wherein retrieving the specific key associated with the specific vehicle identifier comprises:

finding a specific template image for the specific key stored in the computing system associating vehicle identifiers with respective template images; and making a new key based on the specific template image, wherein the new key is made to be identical to the specific key and perform functions of the specific key.

2. The method of claim 1, wherein retrieving the specific key associated with the specific vehicle identifier comprises retrieving the specific key from a specific respective location having a specific location identifier associated with the specific vehicle identifier in the storage facility.

3. The method of claim 1, wherein the second section of the template includes a window sized to view the vehicle identifier of each vehicle of the plurality of vehicles.

4. The method of claim 1, wherein associating each template image with a corresponding vehicle identifier comprises processing the template image to retrieve the corresponding vehicle identifier.

5. The method of claim 1, the operations further comprising:

installing an application in a computing device, the computing device including one or more processors;

executing the application in the computing device, causing the computing device to process the template image to identify the vehicle identifier for the key from the template image; and transmitting the identifier vehicle identifier, together with the template image, to the service provider.

6. The method of claim 5, the operations further comprising:

printing the identified vehicle identifier and attaching the printed vehicle identifier to the key; and sending the key with the printed vehicle identifier to the service provider.

7. The method of claim 6, further comprising:

after receiving the key with the printed vehicle identifier, finding the printed vehicle identifier in the computing system, in response:

confirming receiving the key associated with the identified vehicle identifier stored in the computing system.

8. The method of claim 1, wherein the template includes at least an overlay for providing references lines and outlines to view information of the vehicle key.

9. The method of claim 1, wherein the guide includes one or more of a printed document and an electronic document.

10. The method of claim 1, wherein transmitting the template image of each key to the service provider comprises transmitting the template image to a server provided by the service provider.

11. The method of claim 1, wherein the service provider provides a server, the server allowing the client to perform operations including one or more of viewing the guide, viewing a catalogue including vehicle identifiers, location identifiers and template images corresponding to the plurality of vehicles, searching a specific vehicle identifier in the computing system, requesting to retrieve a specific key of a specific vehicle, and requesting an additional kit.

12. The method of claim 1, comprising:

providing a plurality of tags having respective tag identifiers, a second template, and a second guide to a second client, wherein the second guide includes second instructions for the second client to, for each vehicle of a second plurality of vehicles, perform second operations comprising:

attaching a tag of the plurality of tags to a key corresponding to the vehicle to form a tag-key pair for the vehicle;

placing the tag-key pair into a first section of the second template;

arranging the second template over a portion of the vehicle so that a vehicle identifier of the vehicle is visible through a second section of the second template;

capturing a second template image of the second template so that the tag-key pair and the vehicle identifier are both visible in the second template image;

transmitting the second template image to the service provider; and sending the tag-key pair to the service provider;

receiving the second template image for each vehicle of the second plurality of vehicles and storing the second template images of the second plurality of vehicles in the computing system;

receiving the tag-key pair for each vehicle of the second plurality of vehicles and storing each tag-key pair into a second respective location having a second location identifier in the storage facility; and associating, in the computing system and for each tag-key pair, the corresponding vehicle identifier for the tag-key pair with the second location identifier for the tag-key pair.

13. The method of claim 12, further comprising:

after receiving the tag-key pair, identifying a tag identifier corresponding to the tag-key pair;

finding the identified tag identifier in the computing system associating tag identifiers with respective vehicle identifiers corresponding to tag-key pairs, in response:

confirming receiving the tag-key pair associated with the identified tag identifier stored in the computing system.

14. The method of claim 12, wherein each of the plurality of tags includes an address of the storage facility.

15. The method of claim 1, comprising:

receiving, from a second client, a second plurality of keys corresponding to a second plurality of vehicles attached with respective vehicle identifiers of the second plurality of vehicles;

placing each corresponding key of the plurality of vehicles and the corresponding vehicle identifier in a second template so that the corresponding key and the corresponding vehicle identifier are both visible in the second template;

capturing, for each vehicle of the plurality of vehicles, a second template image of the second template so that the corresponding key and the corresponding vehicle identifier are both visible in the second template image;

storing the second template images of the second plurality of vehicles in the computing system;

storing each corresponding key of the second plurality of vehicles into a second respective location having a second location identifier in the storage facility; and associating, in the computing system and for each corresponding key of the second plurality of vehicles, the corresponding vehicle identifier for the key with the second location identifier for the key.

16. The method of claim 1, comprising:

providing a plurality of tags having respective tag identifiers and a second guide to a second client, wherein the second guide includes second instructions for the second client to, for each vehicle of a second plurality of vehicles, perform second operations comprising:

attaching a tag of the plurality of tags to a key corresponding to the vehicle to form a tag-key pair for the vehicle;

attaching a vehicle identifier of the vehicle to the tag-key pair; and sending the tag-key pair attached with the vehicle identifier to the service provider;

receiving the tag-key pair for each vehicle of the second plurality of vehicles attached with the corresponding vehicle identifier;

placing the tag-key pair for each vehicle of the plurality of vehicles and the corresponding vehicle identifier in a second template so that the tag-key pair and the corresponding vehicle identifier are both visible in the second template;

capturing, for each vehicle of the plurality of vehicles, a second template image of the second template so that the tag-key pair for the vehicle and the corresponding vehicle identifier are both visible in the second template image;

storing the second template images of the second plurality of vehicles in the computing system;

storing the tag-key pair for each vehicle of the second plurality of vehicles into a second respective location having a second location identifier in the storage facility; and associating, in the computing system and for each tag-key pair, the corresponding vehicle identifier for the tag-key pair with the second location identifier for the tag-key pair.

17. A system providing key storage and retrieval services, the system comprising:

a plurality of templates;

a guide including instructions for a client to, for each vehicle of a plurality of vehicles, perform client operations comprising:

placing a key of the vehicle in a first section of a template of the plurality of templates, the key comprising at least one of a physical vehicle key and a key fob;

arranging the template over a portion of the vehicle so that a vehicle identifier of the vehicle is visible through a second section of the template;

capturing a template image of the template so that the key and the vehicle identifier are both visible in the template image;

transmitting the template image to the service provider; and sending the key to the service provider;

a storage facility for storing each key into a respective location having a location identifier; and a computing system comprising one or more computers, wherein the computing system is configured to perform service operations comprising:

receiving the template image for each vehicle and storing the template images of the plurality of vehicles in the computing system;

associating, in the computing system, each template image with a corresponding vehicle identifier;

associating, in the computing system, the associated vehicle identifier with the location identifier of the key corresponding to the vehicle identifier;

receiving from the client a request for a specific key corresponding to a specific vehicle, the request including a specific vehicle identifier of the specific vehicle; and finding the specific vehicle identifier in the computing system, and in response:

retrieving the specific key associated with the specific vehicle identifier, and sending the specific key to the client, wherein retrieving the specific key associated with the specific vehicle identifier comprises:

finding a specific template image for the specific key stored in the computing system associating vehicle identifiers with respective template images; and making a new key based on the specific template image, wherein the new key is made to be identical to the specific key and perform functions of the specific key.

18. The system of claim 17, wherein the first section of the template defines a window sized to permit viewing a vehicle identification number on a surface of a vehicle;

wherein the second section defines one or more cavities shaped to receive at least one of a vehicle key and a key fob of the vehicle; and wherein the first section and the second section are arranged so that a user can view both the vehicle identification number through the window and at least one of the vehicle key and the key fob in the one or more cavities simultaneously.

19. The system of claim 18, wherein the template further comprises:

a third section defining a separate cavity shaped to receive a tag having a tag identifier; and wherein the first, second, and third sections are arranged so that the user can view the tag in the separate cavity, the vehicle identification number through the window, and at least one of the vehicle key and the key fob in the one or more cavities simultaneously.

20. The system of claim 18, wherein the template further comprises a magnet, the magnet configured to allow positioning the template on the surface of the vehicle to view the vehicle identifier so that the user doesn't need to hold the template by hand.

* * * * *